United States Patent [19]

Gergely

[11] 4,312,698

[45] Jan. 26, 1982

[54] FIBROUS ROD FORMING DEVICE

[75] Inventor: Alex S. Gergely, Powhatan, Va.

[73] Assignee: Philip Morris, Inc., New York, N.Y.

[21] Appl. No.: 111,503

[22] Filed: Jan. 11, 1980

[51] Int. Cl.[3] ..... D04H 3/00

[52] U.S. Cl. ..... 156/441; 156/498; 156/500; 425/106; 425/115; 425/122; 425/440; 425/447; 425/505; 425/508; 425/509; 493/42; 493/43; 493/49

[58] Field of Search ..... 425/363, 106, 110, 115, 425/126, 440, 447, 122, 508, 509, 505; 264/285, 280; 156/166, 500, 583.1, 583.5, 498, 433, 441; 493/42, 43, 49, 50

[56] References Cited

U.S. PATENT DOCUMENTS

| | | | |
|---|---|---|---|
| 3,297,512 | 1/1967 | Cobb et al. | 156/433 |
| 3,455,766 | 7/1969 | Berger et al. | 156/433 |
| 3,624,722 | 11/1971 | Stone | 493/42 |
| 3,716,443 | 2/1973 | Preston | 156/441 |

*Primary Examiner*—Willard E. Hoag

*Attorney, Agent, or Firm*—Arthur I. Palmer, Jr.; George M. J. Sarofeen

[57] ABSTRACT

A ridge remover for smoothing and shaping rod surfaces where jointure marks occur in fibrous rod manufacture when made using a porous belt garniture device.

3 Claims, 9 Drawing Figures

FIBROUS ROD FORMING DEVICE

BACKGROUND ART

Fibrous rod manufacturing is carried out by means of automatic methods, such as those shown in U.S. Pat. No. 3,455,766. Such rods are used extensively in cigarette filter making and are formed of continuous cellulose acetate tow which is first treated with plasticizer and then flooded with steam to accelerate the action of the plasticizer.

In the prior art at least one method, such as that shown in the above-mentioned U.S. Pat. No. 3,455,766, utilizes an endless, flexible, porous belt which is continuously moved through a treating and forming apparatus in processing machinery. The belt is wrapped around the material after the plasticizer is added to form the same into an elongated element. While the material is so confined in the belt, steam and then a cooling gas are passed through the belt and into contact with the tow material. This acts to first activate the plasticizer, a bonding constituent, in the material and then rigidify the tow material into a rod. After separation from the belt, the rod may be subdivided to form cigarette filter plugs or the like.

In the formation of the rod, an undesirable ridge is formed where the edges of the garniture belt meet in generally imperfect register to imperfectly complete the rod forming closure about the tow. A ridge remover is provided for smoothing the undesirable ridge, such as that shown in said U.S. Pat. No. 3,455,766. However, such a prior ridge remover as is shown and described in said U.S. Pat. No. 3,455,766 and other designs have not fully met the need for producing a smooth radius at the ridge location. Cigarettes made with filters having a ridged surface of this type may pass unfiltered smoke adjacent the ridge line thereby bypassing the filter and at least partially negating the basic function of the filter. It is highly desirable to, therefore, produce a filter with a substantially uniformly smooth surface comprising a relatively uniform radius of curvature about the whole periphery.

DISCLOSURE OF INVENTION

The present invention is incorporated in the design and construction of a ridge remover which conforms the ridged area of a filter rod, which is imperfectly formed at the juncture of the garniture belt edges, to the desired degree of surface smoothness and substantially arcuate configuration needed to produce a smooth-surfaced, uniformly contoured filter rod. The ridge remover of the present invention has in addition an adjusting mechanism for ease of adjustment and is provided with belt guide recesses which are built into the ridge remover body to receive and control the pass through of the edges of the garniture belt in a manner so as to reduce wear and tear on the belt edges and increase belt life. The smoothness of rod curvature is maintained by making the rod contacting portion of the ridge remover curved to the desired form in the transverse direction. The belt saving feature is comprised in smoothed guide recess belt edge receiving and tracking grooves provided in the sides of and along the length of the ridge remover shoe just above the level of the surface of the tow rod.

BEST MODE FOR CARRYING OUT THE INVENTION

Figure 1:
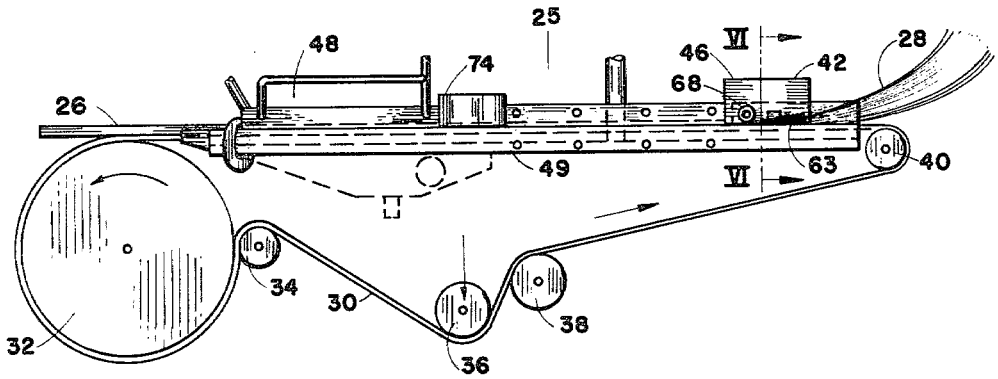
FIG. 1 is a side elevational view, partly schematic, of one form of an apparatus in acccordance to which this invention is applicable, shown in use for the production of a stable elongate element from a continuous filamentary tow.
Figure 2:
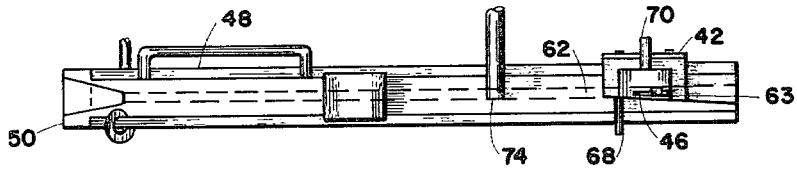
FIG. 2 is a top plan view of the basic apparatus of the apparatus as shown in FIG. 1.

Referring now to the drawings in general, and more particularly to FIGS. 1 and 2, one form of an apparatus in accordance with this invention is designated generally by the reference numeral 25. FIG. 1 illustrates the formation of filter rod 26 from a continuous filament tow 28. Details of the formation of such a filter rod product from filamentary tow 28 and its pretreatment, such as handling and plasticizing as well as subsequent handling of the product 26 such as subdividing to form individual filter plug elements, can be found in U.S. Pat. No. 3,455,766.

An endless, flexible, porous belt 30 is driven in a continuous orbit, such as for example by the drum 32. During each orbital travel, the belt 30 passes over a plurality of idlers 34, 36, 38, and 40, one of which (shown at 36) may be adjustably positioned to selectively vary the tension on the belt 30.

The apparatus 25 includes an initial forming station 42 at the entrance end of the same which receives the belt 30 and the tow 28 and folds the belt around the tow 28 until the longitudinal edge portions 30*a* and 30*b* of the belt 30 are juxtaposed and the tow 28 is confined therewith. From the initial forming station 42, the belt with the tow inside is moved into a steam-treating station 46 wherein steam is passed through the belt into contact with the tow to activate a bonding constituent such as the plasticizer triacitin of the tow which has been added prior to the tow reaching the station 42. In this stage the longitudinal edge portions of the belt 30 do not form a perfect seam in the rod of tow where they meet and give rise to the necessity to provide a means for smoothing the ridge created at this imperfect jointure of the edges of the belt. To achieve this needed smoothing function, the belt and tow are then passed into a ridge remover station 46 in which any longitudinal seam formed on the tow by the imperfect mating of the edge portions of the belt is eliminated by pressingly engaging such portion of the tow with the smooth-faced, contoured, ridge-removing element of the present invention while the belt carries the tow past the same as shown at 47 of FIG. 5.

After such ridge removing operation, the belt and tow therewithin are moved to a cooling station 48 wherein air or other such fluid medium is passed through the belt and into contact with the tow to deactivate the bonding constituent, if necessary, and to dry the tow by removing the steam condensate therefrom whereby the tow is rigidified to form the continuous, stable, elongated element 26.

Referring now to the remainder of the drawings for various structural details and features of the apparatus of the invention, it will be seen that the elements defining the various processing stations discussed hereinabove are carried by a common elongated supporting member 49. Specifically the various elements of the apparatus are carried by a base channel member 50 containing an upwardly opening channel extending substantially the entire length of the apparatus 25 beneath a lineal portion of the orbital path of the belt 30. It will be seen that conventional filter plug-making machinery can be readily adapted to support the channel member 50 and thereby the entire processing line to which this invention is applied. For example, the well known Hauni plug-making machinery is adapted to manufacture tow-type filter rods which require overwrapping to facilitate subsequent processing and handling. The garniture assembly of such equipment can be removed and replaced with a modified garniture support element which will adapt the Hauni device to carry and operate the type of equipment for manufacturing nonwrapped tow filter rods to which the present invention applies and which is described in U.S. Pat. No. 3,455,766. Such a substitution will not in any way affect the conventional tow preparation processing equipment, the conventional cooperating cutter head assembly, or the like. It is not considered necessary to illustrate the details of such a modified garniture arrangement since construction of such an element will vary depending on the conventional equipment to be adapted for processing of nonwrapped filters.

In the following description, however, it will be assumed that a continuous filamentary tow 28 has been formed from spinneret devices by any of the established techniques widely used in the industry today for formation of "cigarette filter" tows and that the tow 28 has been stored, such as in a bale or the like (not shown), from which it has been withdrawn as desired for the further processing now to be described. Such a tow 28 is generally referred to as a "raw" or "untreated" tow, and, as is well known, the fibers thereof are normally crimped and unbonded.

Known techniques, such as are described in U.S. Pat. No. 3,313,306, can be initially followed in carrying out the instant invention, and as shown in FIG. 1 therein the raw tow 28, in its crimped form, is passed through a conventional banding device (not shown) which comprises multiple jets disposed to blow air under pressure against the tow so as to separate the individual fibers thereof. The banded tow may then be passed between pairs of rollers (not shown) to render the crimps therein of uniform character, following which the material passes through another banding device (not shown) which may be utilized to spread the two into a relatively thin filamentary layer. The filamentary layer is then passed through a plasticizing device (not shown) wherein a suitable plasticizer such as triacetin, triethyl citrate or the like is sprayed by suitable jets onto one or both sides of the filamentary layer to form a plasticized tow 28. The quantity of plasticizer may vary, although the instant invention requires no more than and frequently less than prior art techinques.

Any conventional feeding means such as the pair of rollers may be utilized to deliver the plasticized tow 28 onto the endless belt 30 to be described in more detail hereinafter. Of course, it is to be understood that at least one of a set of feed rollers must be driven to effect the withdrawal of the "raw" tow 28 from the bale for feeding of the same to the belt 30 for carrying it through the subsequent processing stations of FIG. 1.

The tow speed can be sufficiently great to provide satisfactory commercial production rates. Speeds of up to 200 meters per minute have been utilized with acceptable product characteristics. Of course, the feeding rate must be correlated with the capacity of the various processing stations to insure that the resultant elements will have satisfactory properties. Such correlation can be readily accomplished by those with ordinary skill in the art.

If desired for special functional filtering characteristics, an additive may be substantially uniformly dispersed in the preparatory steps across at least the major portion of the width of the relatively thin layer of plasticized tow 28 by merely feeding the same from a suitable additive dispensing means (not shown). Such additives may be in the form of a liquid or in the form of a particulate material and may serve to modify the structural or functional properties of the final product. For example, various sorbent materials may be included to improve the filtration effected by the final product if the same is to be used as a cigarette or industrial filter. Exemplary of such materials are activated carbon, silica gel, alkali metal aluminosilicates, such as molecular sieves sold by Linde Company, a Division of Union Carbide Corporation, sucrose, activated alumina, volcanic ash, granular calcium carbonate, granular sodium carbonate, fuller's earth, magnesium silicates, metallic oxides such as iron oxide and aluminum oxide, metal treated carbon and the like. Additionally, where porosity or strength properties are a major consideration, metal fibers or even fibrous carbon can be included. Moreover, taste modifiers such as menthol or other similar materials may be incorporated for obvious purposes. Additionally, certain particulate resinous materials such as finely divided polyethylene or polypropylene may be included to improve the binding characteristics as well as rhe filtration properties of the final product. Mixtures of the above materials are also contemplated. Although it is important to recognize that while the additives and/or fillers listed above can be used if a particular effect is desired, they must be maintained in minor proportion in the overall construction, generally not more than about 30 percent by volume, if a structure having the basic characteristics of a continuous filamentary tow is desired.

The endless, flexible, porous belt 30 is utilized to define a continuous material-forming and carrying surface and is orbitally trained about a group of path-defining rollers 34, 36, 38 and 40, at least one of which is driven by any conventional means (not shown). The roller 36 is mounted in the path of travel of the belt 30, to facilitate maintaining a desired tension on the belt.

The preferred embodiments of this invention contemplate using a woven nylon belt preferably having a porosity such that the various gaseous mediums, e.g., steam and air, to be utilized in treating the material therewithin in the processing stations to be described in more detail hereinafter, can pass through the belt and actually penetrate the material for optimum and substantially uniform results throughout the entire cross-section of the material. Preferably, of course, the pores in the belt are smaller than any of the enveloped material although the housings of the processing stations may assist in cooperating with the belt to retain the material therewithin.

If desired, the belt 30 may be provided with a lubricating or wear-resisting coating such as polytetrafluoroethylene or a silicon emulsion. Such materials improve the water resistant properties of the belt as well as preventing adhesion between the belt fibers and the material carried thereby.

Figure 3:
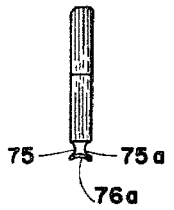
FIG. 3 is an end view of the ridge remover of this invention.
Figure 6:
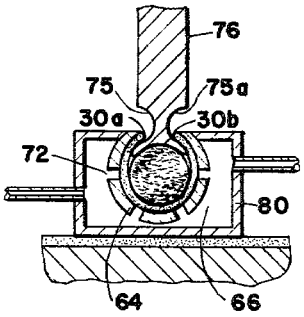
FIG. 6 is a transverse cross-sectional view taken substantially on line 6—6 of FIG. 1.
Figure 7:
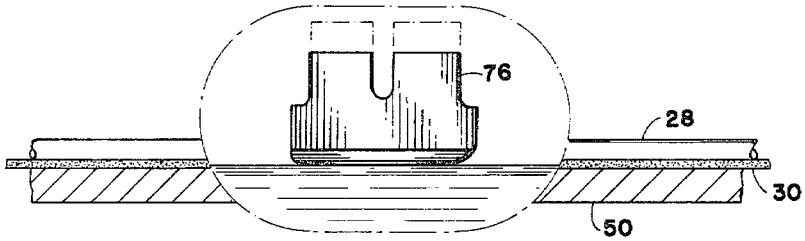
FIG. 7 is an enlarged view in elevation showing the ridge remover of the present inventon mounted in place adjustably over a tow rod.
Figure 8:
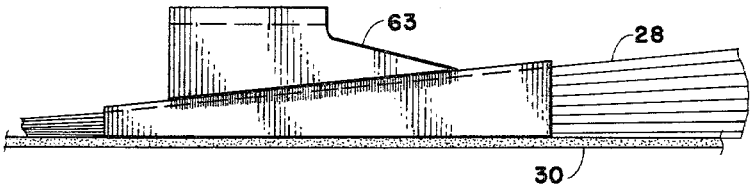
FIG. 8 is an elevational view of tow forming tongue.

Referring now more particularly to FIGS. 1–3, the plasticized tow 28, with or without additives, is fed onto the belt 30 by rollers, and passes through a garniture 42 in advance of a steam-treating station 46. The belt 30 is initially formed around the tow 28 by an elongated, open arcuate trough 62 (not shown in FIG. 1 for illustrative clarity) and the tow 28 is guided into the belt 30 by an elongated, concavely curved tongue 63 fitting within the trough 62 and the belt 30. Portions of the steam-treating station 46 define an elongated bore 64 (not shown) which receives the belt 34 and the tow 28 from the trough 62 and the tongue 63. The bore 64 has a circumference so dimensioned with respect to the width of the belt as to form the belt into a substantially closed cross-section as it moves through the bore as shown in FIG. 6. The curve of the tongue 63 constantly decreases in cross-section and the smaller end of the tongue extends into the bore 64 as will be seen in FIG. 6 until the belt 30 is substantially completely closed about the tow 28 to insure that the tow is guided into the closed belt. However, the tongue can terminate at the entrance of the bore, and the belt can there close. This forming of the belt and thereby the tow is accomplished at least partially in the initial portions of the steam-treating station 46 for convenience, but it will be understood that separate means may be included to effect this function, if desired.

Figure 5:
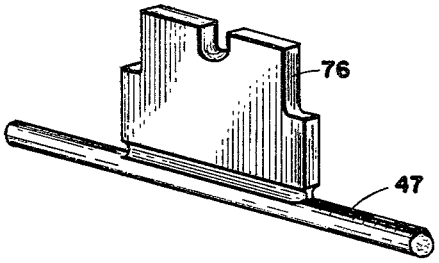
FIG. 5 is a view in perspective.

Since there is some difficulty in forming the belt around the tow in a manner to provide a perfect meeting of the longitudinal edges of the belt, a longitudinal seam 47 as shown in FIG. 5 will ordinarily result during this initial forming operation. In order to remove this seam by a pressing operation to be explained in more detail hereinafter and compensate for the change in cross-sectional shape of the tow resulting from the same-removing operation, the tow may preferably initially be formed into a slightly vertical, elongated or substantially vertical, elliptical shape.

An insert (not shown) is carried within the chamber 42 which receives steam from a source of the same (not shown) through a pair of oppositely disposed conduits 68, 70. A plurality of radially spaced passageways 72 are defined in the insert 64 communicating between the chamber 66 and the central area in which the belt 30 and tow therein are confined. Thus, steam under pressure is passed continuously and directly through the porous surface of the belt 30 and into the tow as the same is carried by the belt through the steam-treating station, to produce a steam-treated tow which can be generally of elliptical cross-section and having the longitudinal seam ridge 47. In this manner the bonding constituents of the tow are activated by the steam while the tow is in a relaxed or substantially tensionless condition since it is being carried by the belt, rather than pulled through the processing station by some forwardly-positioned pulling means.

The steam requirements can be varied by those with ordinary skill in the art to produce the desired activation of the bonding constituents of the tow, but, as will be seen from the subsequent examples, it has been found that with a tow feed rate of approximately 400 meters per minute and a tow cross-section of approximately 0.5 $cm.^2$, approximately 24 pounds per hour of steam provides satisfactory results.

Figure 4:
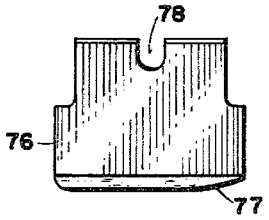
FIG. 4 is a side elevational view of the ridge remover shown in FIG. 3.

Referring now particularly to FIGS. 1 and 6, the belt 30 with the steam-treated tow therein moves from the steam-treating station 42 toward the cooling station 48. However, before entering the cooling station 74 ridge remover foot 76 engages the longitudinal seam 47 between the edges of the belt 30 to remove the same from the tow, a pair of longitudinally disposed guide grooves 75 and **75*a* are provided in the sides of the ridge remover 76 at the lower edge thereof parallel to and adjacent the presser foot 76*a* for receiving and guiding the longitudinal edges of the belt 30. This action guides the belt edges at an angle which allows the belt edges along with the lower curved surface of presser foot 76*a*, to form a tow smoothing arrangement which provides a substantially cylindrical forming guide and ridge smoothing combination for producing a cylindrical tow element of substantially circular cross section and relatively free of projecting ridges. The presser foot 76 is disposed in spaced relationship to an arcuate trough (not shown) formed at the entrance to the cooling station 48 so that the pressure resulting from engagement with the ridge remover foot 76 simultaneously reforms the tow 26 into a substantially circular cross-section as will be seen in FIG. 6 which corresponds to the desired cross-section of the final product. It is to be understood, once again, that the elements are somewhat exaggerated for illustrative purposes and that the presser foot 76 need not be, for example any more than approximately 3/16" in cross-section under ordinary circumstances. A modification of the presser foot 76 is shown in FIG. 4 where the leading edge is shown to be tapered at 77. The mounting slot 78 shown in FIG. 4** is adapted to receive a mounting bolt and may be secured by said bolt within a range of adjustability to or away from the tow.

The housing 80 of the cooling station 48 defines a confined area in the form of an elongated cylindrical bore of a circular cross-section substantially corresponding to that of the final product as will be seen in FIG. 6. The circumference of the confined area in the cooling station 48 is substantially equal to the width of the belt 30 whereby the longitudinal edges of the belt ride in grooves 75 and **75*a* during passage through the cooling station. It will be noted that the cooling station 48 is substantially longer than the steam-treating station 42** since it has been found that the production speed of the apparatus is dependent on the cooling capabilities in this staton.

In order to provide for the most efficient cooling characteristics the station 48 is provided with a pair of elongated plenum chambers which communicate with the confined area through which the belt 30 and the tow therein passes, by means of a plurality of longitudinally spaced passageways. The plenum chamber receives air or other inert cooling gas, preferably under pressure, through a conduit from a source (all not shown) vacuum being supplied at this point, if desired. In any event, the cooling gas is actually forced through the steam-treated tow as the same is carried by the belt 30 through the cooling station 48. Once again, the drying of the tow and the setting of the bonding constituents of the same take place substantially in the absence of any tension.

As in the case of the steam requirements, the cooling gas may be varied within the skill of the ordinary artisan to insure that the desired characteristics in the final product will be obtained. It has been found, however, as will be seen from the subsequent examples, that with a tow feed and cross-section such as described with regard to the steam requirements, approximately 19.5 cubic feet per minute of air at room temperature, e.g. 70° to 85° F., and 14 psig produces satisfactory results.

At the cooling station, the gas is passed into and through the formed material for essentially two purposes, namely, to cool and set or cure the previously activated bonding constituent and to remove excess moisture from the material, when the steam is passed to and into the tow to activate the bonding constituent, there is a tendency for the same to condense thus giving the product excessive moisture. Moreover, the steam expedites the action of the plasticizer on the tow—i.e., it activates the bonding constituent so as to cause instantaneous bonding of the plasticized material. Thus, while the steam serves to efficiently and uniformly activate the bonding constituent at high speeds, it has been found necessary at the cooling station to not only deactivate the bonding constituent but to also remove the excess moisture. In fact, the steam preferably causes full utilization of the plasticizer and the cooling gas then basically functions to remove excess moisture in the tow resulting from condensation of the steam and rigidify the rod being produced. Therefore, the terminology "set the bonding constituent" as used in the specification and claims is to be understood as including the operation just described when there is no plasticizer remaining in the tow to deactivate after the steam treatment.

With respect to the operations at both the steam treating and cooling stations, it is significant to note that the steam and air respectively pass to and into the tow without experiencing any significant or substantial flow resistance from the belt. The belt is thus sufficiently porous by virtue of its open mesh characteristics, to effectively permit vapor and gas passage therethrough without obstruction. This is to be distinguished from a fabric or closely woven belt wherein heat may be conducted therethrough, but obstruction and resistance is encountered in the passage of any gas or vapor therethrough.

The product 26 is peeled from the belt 30 as the same leaves the cooling station 48 and the belt 30 is substantially flattened and continuously orbited over the path-defining and tensioning rollers to receive additional plasticized tow 28 in advance of the steam-treating station 42. Thus, uninterrupted processing of the tow is effected by forming and carrying the same in the belt 30 with substantially no tension on the tow during the steam and cooling procedures.

The product 26 is in the form of a stable, self-sustaining, elongated element shown illustratively as substantially circular in cross-section in FIG. 6 although it is to be understood that similar techniques could be utilized for the production of elements of substantially any other desired cross-section. The resultant product 26 has the individual filaments of the tow bonded to each other at spaced points to form a porous mass which, when used as a smoke filter, defines a plurality of tortuous paths for the passage of the smoke whereby effective filtration can be realized. The peripheral surface of the product 26 is rounded smoothly as a result of the ridge removing action produced by the surface configuration of the lower rounded surface **76*a*** of ridge remover foot. This smoothed surface functions to prevent an excessive gap to be formed at the periphery of the product when overwrapped as well as providing the periphery with improved bonding properties for more uniformly adhesively securing the same to a paper overwrap such as the "tipping" overwrap conventionally used in the formation of filter cigarettes or the like. This latter characteristic is in sharp contrast with the relatively open channel formed at peripheral surface resulting from various prior art attempts at producing self-sustaining elongated bodies which are relatively free of ridged seams.

The product 26, after having its pressure-drop properties measured, if desired, can then be severed by any conventional means (not shown) into individual segments of at least substantially equal length.

Although a "tipping" overwrap is conventionally utilized to attach a filter element such as the product of the instant invention to a tobacco section of a cigarette or the like, such an arrangement is to be distinguished from the utilization of a paper overwrap for the elongated element itself to provide dimensional stability. Such prior art paper overwraps are necessary during the processing cycle whereby, as pointed out earlier, pressure drop characteristics of the product cannot be monitored without removing sample portions from the production line. In contrast, since there is no overwrap utilized in the production of the continuous element according to the instant invention, the product 26 can be passed through a pressure drop measuring means of conventional design (not shown) in order to continuously and directly monitor this property of the product without removing samples at selected intervals as has been necessary heretofore. By this technique, any conventional means may be utilized to translate the pressure-drop reading illustratively shown on a gauge into a control for the rate of feed of the tow 26. In this manner, feeding of the tow 26 may be automatically and continuously varied in response to any changes in pressure drop of the product whereby substantially constant pressure drop characteristics may be maintained. In other words if the pressure drop of the product is found to be above the optimum value indicating that the product is too dense, the rate of feeding the tow into the steam-treating station 42 can be automatically reduced to compensate therefor. Similarly, if the pressure drop characteristics are below the desired optimum, the tow feed can be increased. Means for effecting this continuous measuring of the pressure drop properties of the product, and controlling the feed of the tow in response thereto while not shown in the drawings, may be of mechanical and electrical devices to effect these operations which can be readily designed by those with ordinary skill in the art.

Figure 9:
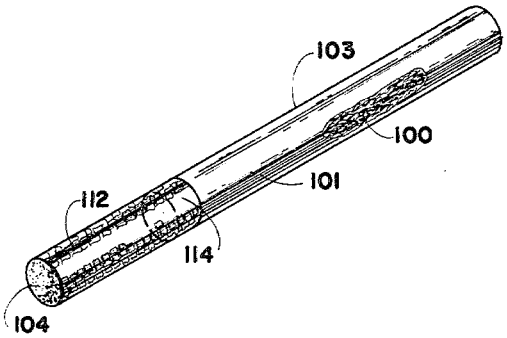
FIG. 9 is a view in perspective of a cigarette incorporating the tow product of the invention.

The smoothing of product segment 26 improves it for use as a cigarette smoke filter as shown in FIG. 9 wherein a mass of tobacco 100 overwrapped with conventional cigarette paper 101 to form a tobacco section 103 is secured to the filter plug 104 by a conventional "tipping" ovewrap 112. Preferably, the "tipping" overwrap 112 is adhesively secured substantially uniformly to the smoothed peripheral surface of the filter plug 104 and includes an integral extended portion 114 adhesively secured to the cigarette paper 101 at one end of the tobacco section 103. In this manner a single overwrap for the filter plug functions to attach the same to the tobacco section and simultaneously precludes channelling of smoke around the periphery of the filter plug. As explained hereinabove, the smoothed periphery of the filter plug 104 improves the bonding capabilities necessary for adhesively securing the same to the tipping overwrap 112 by providing an increased surface area for reception of the adhesive material.

Although the instant inventive concept has been generally described with reference to the production of cigarette filters or the like, it will be seen that the resultant method may have many other uses, both related and unrelated to the smoke filtration of a filter cigarette. For example, individual filter segments may be utilized as industrial smoke filters or gas liquid contact elements whereby the material being processed passes directly through the element as in a cigarette filter or, alternatively, into peripheral contact with a plurality of such elements as in the well known "stacked columns." Further, the capillary properties of the product of the instant invention may be utilized, for example, in the use of the product elements as ink absorbers within dispensing containers such as the common "felt" marking devices. Other similar applications for such products will be obvious to those with ordinary skill in the art and it is intended that the reference throughout this specification to smoke filters be considered merely as illustrative of the preferred use, rather than as limiting on the instant inventive concept.

Thus, it will now be seen that there is herein provided improved stable, elongated elements of smooth surface configuration which satisfy all of the objectives of the instant invention, and others, including many advantages of great practical utility and commercial importance.

Since many embodiments may be made of the instant inventive concepts, and since many modifications may be made of the embodiment hereinbefore shown and described, it is to be understood that all matter herein is to be considered merely as illustrative and not in a limiting sense.

Accordingly, what is claimed is:

1. An apparatus for making a stable elongated element of tow from a continuously fed metered supply of fibrous or particulate matter or a combination of the both wherein bonding of the matter is activated by heating and wherein the tow element is subsequently rigidified by cooling, said apparatus including:

a. an endless, flexible belt with longitudinal edges adapted to form a butt joint:

b. means for moving the belt through a continuous orbit;

c. means for feeding the tow onto the belt during a portion of its orbit and wrapping said belt about said tow to encase said tow and form a butt joint where the edges of said belt meet;

d. means for forming the tow into a predetermined shape;

e. means for heating the tow while moving with and encased within said belt while said belt and tow are maintained in predetermined shape to thereby initiate bonding of the fibrous or particulate matter together;

f. means for cooling the tow while the belt is moving and encasing the tow in predetermined shape to thereby rigidify the tow and form the same into a stable continuous element of the predetermined shape; and g. means for separating the stable continuous element from the longitudinal edges of the belt adjacent the longitudinal edges thereof comprising a ridge remover element with longitudinal walls forming guide grooves for receiving said belt edges and serving as a positive guide for said belt edges;

1. said ridge remover supported in said linear portions of the orbital paths of the belt having a substantially T shaped element extending between the longitudinal edge portions of the belt, said ridge remover having a tow contacting surface curved in the transverse direction to the direction of travel of said tow substantially to the curvature of surface desired to be imparted to the surface of said tow for smoothing that portion of the tow formed longitudinally on said tow at the juncture of said belt edges and a stem portion of said substantially T-shaped element extending outwardly of said belts, said portion having said guide grooves in opposite said longitudinal walls thereof reducing thickness of said portion.

2. The ridge remover of claim 1 having a tapered leading edge adapted to intercept said tow.

3. The ridge remover of claim 1 further comprising walls defining mounting slots adapted to provide multiple mounting locations.

* * * * *